US007497544B2

(12) United States Patent
Takagi

(10) Patent No.: US 7,497,544 B2
(45) Date of Patent: Mar. 3, 2009

(54) DROPLET DISCHARGING HEAD, DROPLET DISCHARGING DEVICE AND MANUFACTURING METHOD OF MICROARRAY

(75) Inventor: Fumio Takagi, Chino (JP)

(73) Assignee: Seiko Epson Corporation (JP)

( * ) Notice: Subject to any disclaimer, the term of this patent is extended or adjusted under 35 U.S.C. 154(b) by 376 days.

(21) Appl. No.: 11/372,424

(22) Filed: Mar. 9, 2006

(65) Prior Publication Data

US 2006/0214978 A1 Sep. 28, 2006

(30) Foreign Application Priority Data

Mar. 23, 2005 (JP) ..... 2005-084522

(51) Int. Cl.
*B41J 2/165* (2006.01)
*B41J 2/175* (2006.01)

(52) U.S. Cl. ..... 347/20; 347/29; 347/30; 347/32; 347/85

(58) Field of Classification Search ..... 347/20, 347/29, 30, 32, 84–87, 45, 64, 67
See application file for complete search history.

(56) References Cited

U.S. PATENT DOCUMENTS 5,988,787 A * 11/1999 Watanabe et al. ..... 347/22
6,142,606 A * 11/2000 Kubota et al. ..... 347/45
6,365,378 B1 4/2002 Hirota et al.
6,465,190 B1 10/2002 Hirota et al.
6,649,343 B1 11/2003 Hirota et al.
6,656,432 B1 12/2003 Hirota et al.
6,753,144 B1 6/2004 Hirota et al.
6,776,960 B2 8/2004 Hirota et al.
6,814,937 B1 11/2004 Hirota et al.
6,852,545 B2 2/2005 Hirota et al.
6,875,404 B2 4/2005 Hirota et al.
7,172,262 B2 * 2/2007 Sugimura et al. ..... 347/29
2002/0158939 A1 10/2002 Shima
2003/0040107 A1 2/2003 Hirota et al.
2003/0104465 A1 6/2003 Hirota et al.
2004/0146916 A1 7/2004 Hirota et al.

FOREIGN PATENT DOCUMENTS

JP 11-187900 7/1999
JP 2001-337096 12/2001
JP 2004-160904 6/2004
JP 2004-226321 8/2004

* cited by examiner

*Primary Examiner*—Shih-Wen Hsieh
(74) *Attorney, Agent, or Firm*—Harness, Dickey & Pierce, P.L.C.

(57) ABSTRACT

Provided is a droplet discharging head, including: a nozzle formed on a first principal surface; a pressurized room having a pressurization unit that applies pressure on liquid discharged from the nozzle; a liquid retention unit in communication with the pressurized room; and a supply port that supplies liquid to the liquid retention unit; wherein the droplet discharging head is used by being mounted on a droplet discharging device in which the supply port is provided protrusively from a second principal surface positioned on the opposite side of the first principal surface.

6 Claims, 8 Drawing Sheets

DROPLET DISCHARGING HEAD, DROPLET DISCHARGING DEVICE AND MANUFACTURING METHOD OF MICROARRAY

BACKGROUND

1. Technical Field

The present invention relates to a droplet discharging head, droplet discharging device, and manufacturing method of a microarray.

2. Related Art

In recent years, a method of detecting and measuring a target substance in a sample with a so-called microarray immobilized on a substrate with biological molecules such as nucleic acid, protein or cells as the probe, and utilizing the specificity of bonding between the biological molecules is being widely used.

JP-A-11-187900 discloses a method for spotting a probe onto a solid phase including the steps of discharging liquid containing a probe, which is capable of specifically bonding with a target substance, to a solid phase surface with an inkjet method, and adhering the probe to the solid phase surface.

With this kind of microarray, since the target substance is detected with a high throughput, it is necessary to fix various types of probe molecules to a minute area. JP-A-2004-160904 discloses an inkjet head including a first substrate having a plurality of liquid retention units, a second substrate having a plurality of channels independently in communication with the plurality of liquid retention units, and one or more head chips having a plurality of nozzles that discharges droplets and which is independently in communication with the plurality of channels. According to this configuration, since the liquid retention units containing a plurality of samples and the plurality of nozzles corresponding to the spotting position of the microarray to be manufactured are in communication via the channels, it is possible to manufacture, at high speed, microarrays in which numerous probes are fixed to a minute area.

SUMMARY

Nevertheless, when using the foregoing inkjet head, it is necessary to fill different samples solutions in the respective liquid retention units before discharge, and much time is required for this filling step. Since the discharge step itself can be conducted in an extremely short period of time, it is important to reduce the time required for the filling step in order to improve the productivity of microarrays.

Thus, an advantage of some aspects of the invention is to provide a droplet discharging head capable of effectively supplying various types of liquids, in a short period of time, to this liquid retention unit.

In order to achieve the foregoing advantage, the droplet discharging head pertaining to the invention includes: a nozzle formed on a first principal surface; a pressurized room having a pressurization unit that applies pressure on liquid discharged from the nozzle; a liquid retention unit in communication with the pressurized room; and a supply port that supplies liquid to the liquid retention unit; wherein the droplet discharging head is used by being mounted on a droplet discharging device in which the supply port is provided protrusively from a second principal surface positioned on the opposite side of the first principal surface.

As a result of adopting the foregoing configuration, by directly immersing the supply port in the liquid to be discharged, the liquid and the liquid retention unit can be made to be in communication with each other. In this state, for instance, the liquid can be sucked into the liquid retention unit by performing suction from the nozzle side. If the inner diameter of the supply port is sufficiently thin, the liquid can also be sucked up based on the capillary phenomenon. Further, since each supply port is provided protrusively from the second principal surface, it can easily be immersed in the solution contained in a small sample container, and there is also an added effect that the second principal surface and liquid retention unit will not be contaminated by coming in contact with the sample solution.

Further, with the liquid discharging head pertaining to the invention, preferably, the supply port and the liquid retention unit are formed integrally in a tubular shape. The configuration of the supply port and liquid retention unit being formed integrally is simple and easy to manufacture.

Moreover, preferably, the supply port is internally configured from a surface having lyophilic property. As a result, it will be easier to suck up the liquid via the supply port, and the effect of capillary phenomenon can be exhibited easier.

The invention also covers a droplet discharging device that is used by being mounted on the droplet discharging head of the invention, including: a fixation unit that fixes the droplet discharging head; and a suction unit that adheres to the first principal surface so as to cover a nozzle of the droplet discharging head, and which is capable of sucking gas or liquid inside the cartridge from the nozzle.

According to the foregoing configuration, liquid can be sucked into the liquid retention unit from the nozzle by mounting the droplet discharging head of the invention on the fixation unit and, in a state where the supply port is in contact with the liquid, operating the suction unit upon affixing it to the first principal surface.

With the droplet discharging device pertaining to the invention, preferably, the fixation unit is capable of rotating the droplet discharging head in plane including the vertical direction. According to the foregoing configuration, the nozzle can be fixed facing upward or downward. If the nozzle if fixed facing upward, since the supply port on the opposite side can be faced downward, the supply port can be made to come in contact with the liquid level in the sample container. Upon discharging the liquid onto the substrate, the nozzle can be fixed facing downward.

Further, preferably, the droplet discharging device pertaining to the invention also includes a gas-liquid separation filter that contacts the nozzle when the suction unit adheres to the first principal surface. By making a gas-liquid separation filter that only permeates gas come in contact with the nozzle, it is possible to prevent the sucked liquid from flowing outside the nozzle and contaminating the first principal surface. Moreover, since it is also possible to eliminate air bubbles in the solution to be discharged, it is possible to inhibit the nozzle from becoming clogged by air bubbles in the discharging step.

In addition, the invention also covers a manufacturing method of a microarray using the droplet discharging device of the invention mounted on the droplet discharging head of the invention. This manufacturing method includes the steps of: preparing a sample solution in a container having a well in the same number as, and disposed in the same spacing as, the supply port; fixing the droplet discharging head so that the nozzle faces upward; immersing the supply port in the sample solution in the well; operating the suction unit upon affixing it to the first principal surface of the droplet discharging head, and introducing the sample solution into the liquid retention unit and pressurized room; separating the suction unit from the first principal surface, and fixing the droplet discharging head so that the nozzle faces upward; and discharging the sample solution to a substrate.

According to the foregoing method, it is possible to fill various types of samples, in a short period of time, from the respective wells of the sample container such as a microtiter plate to the respective liquid retention units of the droplet discharging head via the supply port. After filling the samples, the droplet discharging head is inverted to face the substrate and discharge the sample solution.

Preferably, the foregoing manufacturing method further includes the steps of: after discharging the sample solution to a substrate, fixing the droplet discharging head so that the nozzle faces upward; immersing the supply port in a cleaning solution; and operating the suction unit upon affixing it to the first principal surface of the droplet discharging head, introducing the cleaning solution into the liquid retention unit, and discharging the cleaning solution from the liquid retention unit.

According to the foregoing method, discharging of the sample solution and cleansing of the droplet discharging head can be efficiently repeated to realize the productive manufacture of highly reliable microarrays without any contamination.

DESCRIPTION OF EXEMPLARY EMBODIMENTS

Embodiments of the invention are now described with reference to the drawings.

Droplet Discharging Head

Figure 1:
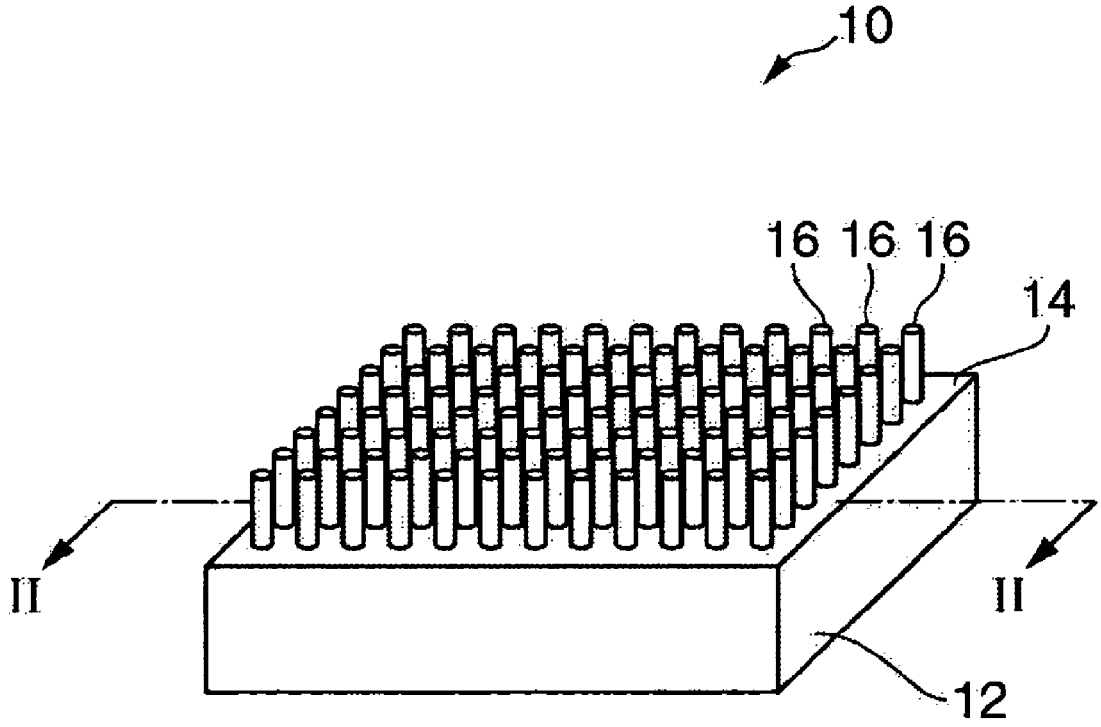
FIG. 1 is a perspective view showing the droplet discharging head pertaining to the invention.

FIG. 1 is a perspective view showing an inkjet head 10 as the first aspect of the droplet discharging head of the invention.

The droplet discharging head 10 has a nozzle at the center of its first principal surface 12, and further has a pressurized room, a liquid retention unit, and a chamber for making the pressurized room and liquid retention unit be in communication with each other. The nozzle, pressurized room, liquid retention unit and channel will be described later. Further, the droplet discharging head 10 has a supply port 16 for supplying liquid to the liquid retention unit. The supply port 16, as shown in FIG. 1, is provided protrusively from a second principal surface positioned on the opposite side of the first principal surface 12.

The droplet discharging head 10 according to this embodiment is configured to have 96 nozzles, 96 liquid retention units and 96 supply ports 16 in 8 rows×12 columns, and is suitable for filling liquid from a microtiter plate having 96 holes into the respective liquid retention units, and discharging the liquid to the respective nozzles.

Figure 2:
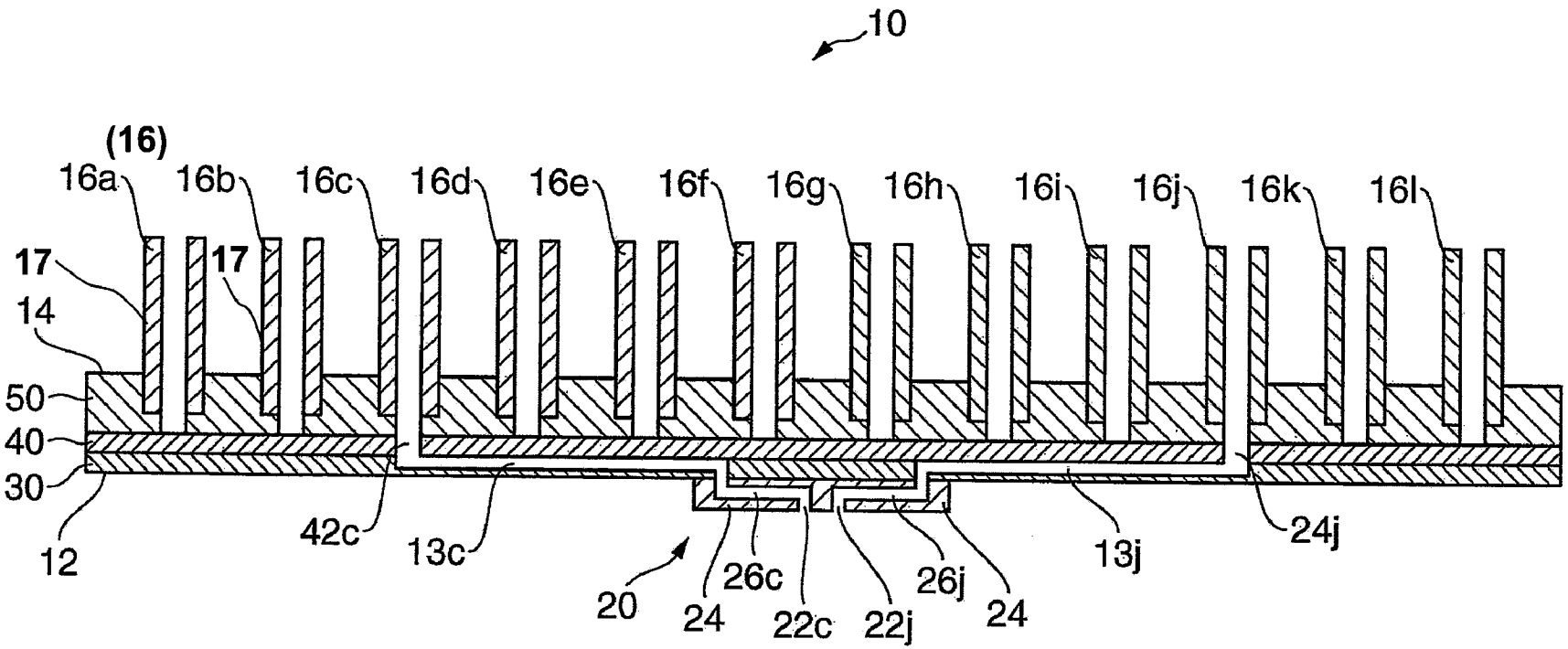
FIG. 2 is an example showing a cross section of the droplet discharging head pertaining to the invention.

FIG. 2 is a cross section showing a frame format along line II-II of the droplet discharging head 10 illustrated in FIG. 1.

A head chip 20 having nozzles is provided to the center of the first principal surface 12 of the droplet discharging head 10. Although 96 nozzles in 48 rows×2 columns are provided to the head chip, in this cross section, only the two nozzles 22*c* and 22*j* are depicted. A pressurized room 26 having a pressurization unit 24 that applies pressure to the liquid to be discharged from the nozzle is formed in the head chip 20. Although one pressurized room is provided to each nozzle, in FIG. 2, only the pressurized rooms 26*c* and 26*j* corresponding to the nozzles 22*c* and 22*j* are depicted.

In this embodiment, with the droplet discharging head 10, since the liquid retention units 17 have the same inner diameter as the supply ports 16, and the supply ports 16 and liquid retention units 17 are formed integrally in a tubular shape, the liquid retention units 17 and supply ports 16 are hereinafter collectively referred to as the "supply ports 16". The supply ports 16 are in communication with the pressure chambers 26 via channels 13. In this cross section, only the channels 13*c* and 13*j* that make the supply ports 16*c* and 16*j* and the pressure chambers 26*c* and 26*j* be in communication with each other are depicted. As described above, since each supply port 16 is in communication with a dedicated nozzle 22 via a dedicated channel 13 and pressure chamber 26, the sample solution will not be contaminated easily.

Like this, the droplet discharging head 10, for instance, may be manufactured by laminating three substrates 30, 40 and 50, inserting the supply port 16 into the hole provided to the substrate 50, and bonding the head chip 20 to the substrate 30.

Figure 3A:
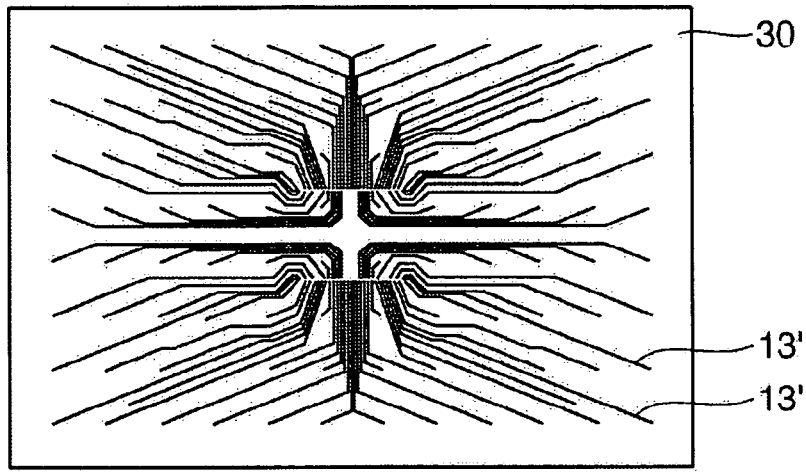
FIG. 3(A) to (C) are examples showing a plan view of the substrates configuring the droplet discharging head pertaining to the invention.

FIG. 3(A) shows a plan view of the substrate 30. By laminating the substrate 40 onto the substrate 30, 96 grooves 13' forming the channel 13 are formed. The grooves 13' are focused from the peripheral edge of the substrate 30 toward the center, and the tail end of each groove 13' at the peripheral edge of the substrate coincides with the pitch (spacing) of the supply ports 16. Meanwhile, a through hole to be connected to the pressure chamber is provided to the tail end of each groove 13' at the center of the substrate.

Figure 3B:
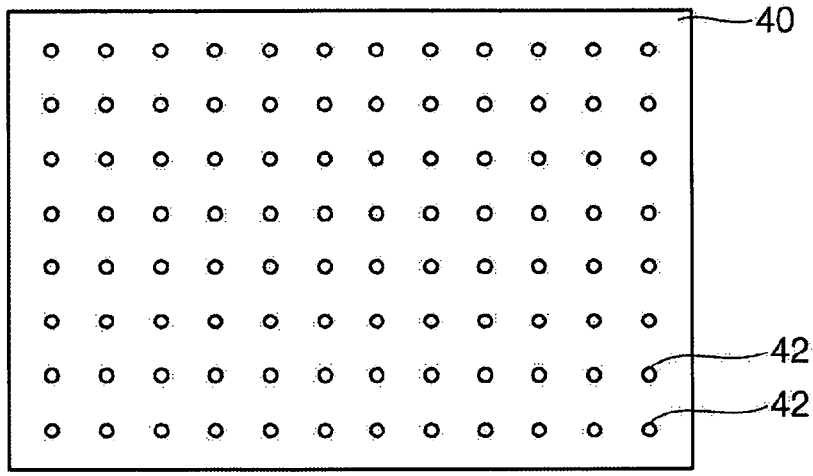

Next, FIG. 3(B) shows a plan view of the substrate that is laminated onto the substrate 30. The substrate 40 has 96 through holes 42 in 8 rows×12 columns. The pitch of the through holes 42 coincides with the pitch of the supply ports 16. The through holes 42 become a channel for communicating the channels 13 and supply ports 16.

Figure 3C:
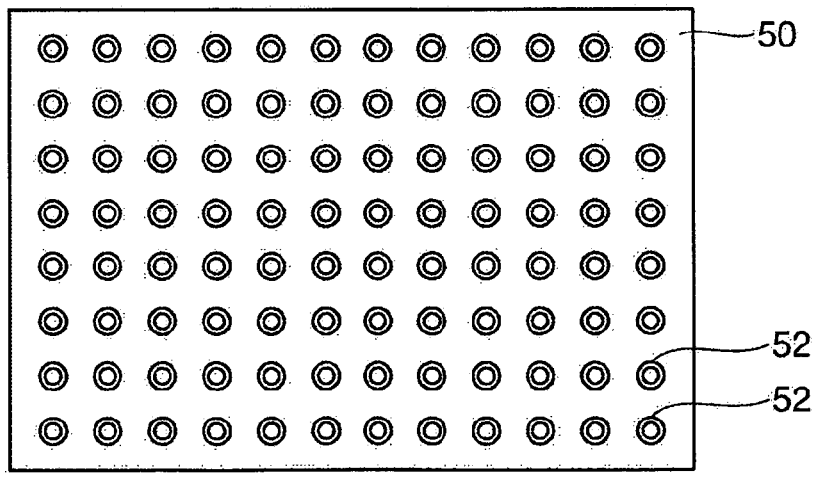

FIG. 3(C) shows a plan view of the substrate 50. The substrate 50 has 96 through holes 52 formed therein. The pitch of the through holes 52 also coincides with the pitch of the supply ports 16, and the through holes 42 of the substrate 40 are in communication with the lower end of the through holes 52. The through holes 52 have an inner diameter in a size up to a prescribed depth as shown in FIG. 2, and the supply ports 16 are fitted therein.

The substrates 30, 40 and 50 can be formed from materials such as glass or resin, and grooves and through holes can be formed via methods suitable for the material such as etching, injection molding and so on.

After laminating and bonding the substrates 30 to 50, the tubular supply ports 16 are fitted into the respective holes of the substrate 50. Although it is preferable to form the supply ports 16 from resin such as acrylic, vinyl chloride, and polycarbonate, they may also be formed from glass or metal. It is preferable that the inner surface of the supply ports 16 has lyophilic property, since this will facilitate the sample solution being sucked into the supply ports 16. As a method of applying hydrophilic property to the surface, there is a method of coating polymer having hydrophilic property and high affinity against biological molecules. As an example of such a polymer, there are hydroxyethyl methacrylate, N-vinyl pyrrolidone, dimethylacrylamide, glycerol methacrylate, polyethyleneglycol methacrylate, and the like.

Further, the head chip 20 is bonded to the substrate 30 in order to complete the inkjet head 10.

Figure 4:
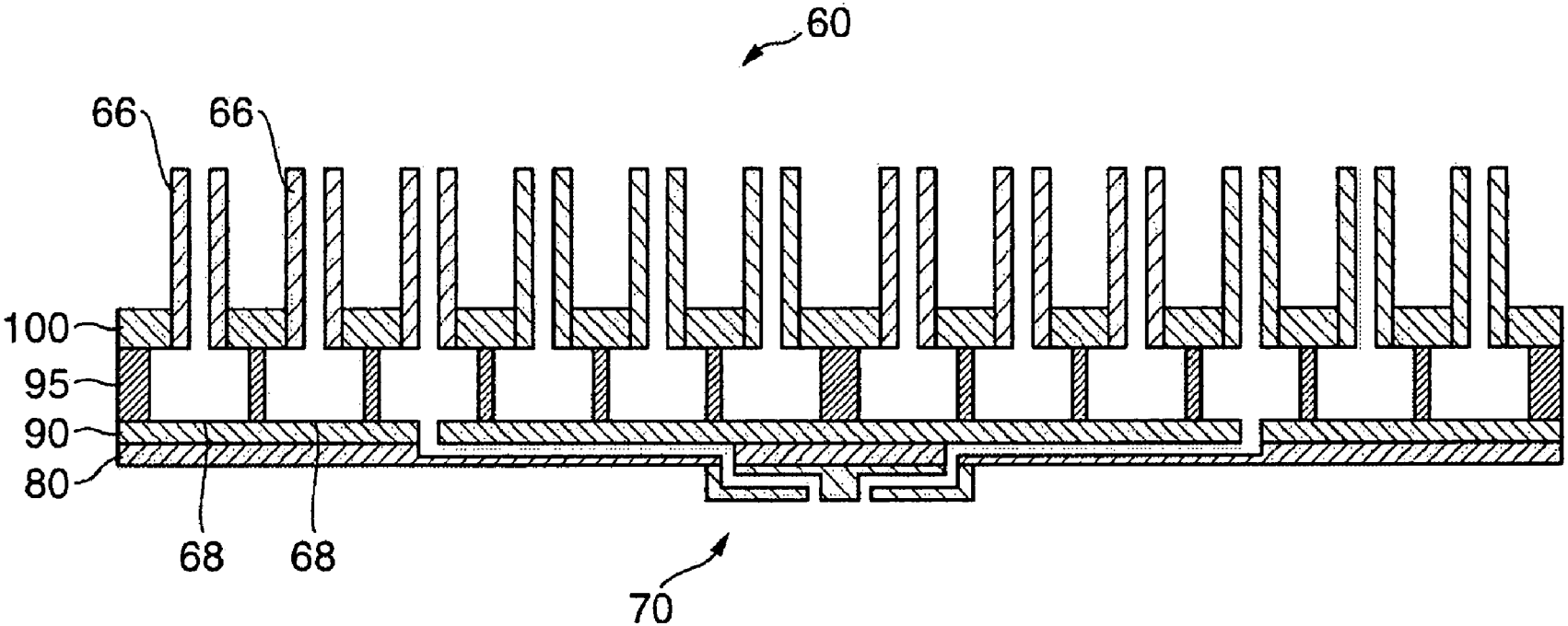
FIG. 4 is an example showing a cross section of the droplet discharging head pertaining to the invention.

Next, FIG. 4 shows an inkjet head 60 as the second aspect of the droplet discharging head pertaining to the invention. The inkjet 60 is configured where a relatively large capacity liquid retention unit 68 is provided separately from a supply port 66. This kind of configuration is suitable in mass producing the same microarrays by repeatedly discharging a sample solution that is once filled in a liquid retention unit 68.

Figure 5A:
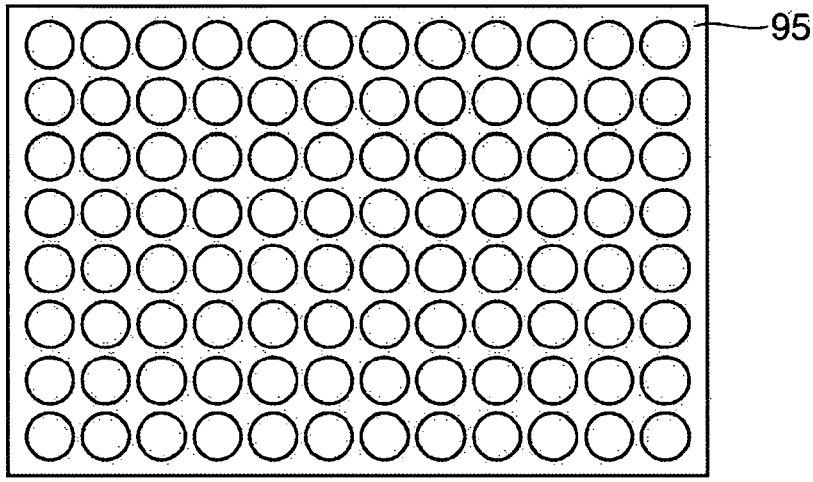
FIGS. 5(A) and (B) are examples showing a plan view of the substrates configuring the droplet discharging head pertaining to the invention.
Figure 5B:
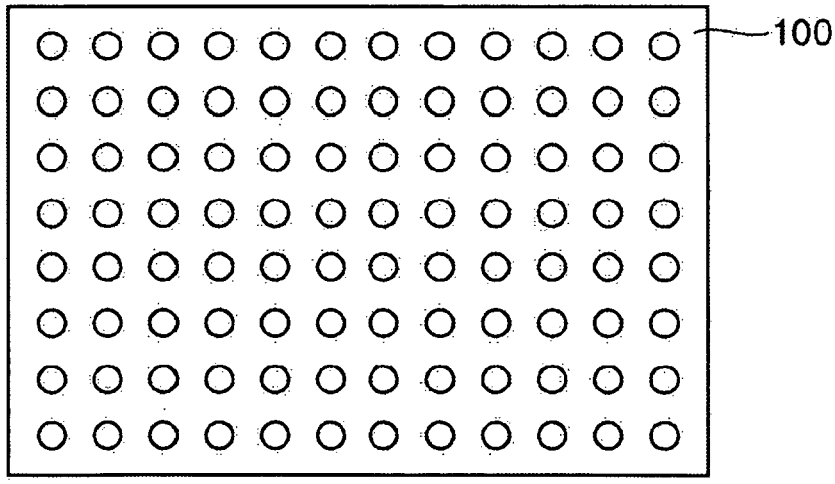

This kind of droplet discharging head can be formed by laminating substrates 80, 90 having the same configuration as the substrates 30, 40 illustrated in FIGS. 3(A) and (B), and laminating a substrate 95 depicted in FIG. 5(A) and a substrate 100 depicted in FIG. 5(B). By changing the thickness of the substrate 95 and the diameter of the through holes, it is possible to form a liquid retention unit of a desired capacity.

Microarray Manufacturing Device

Figure 6:
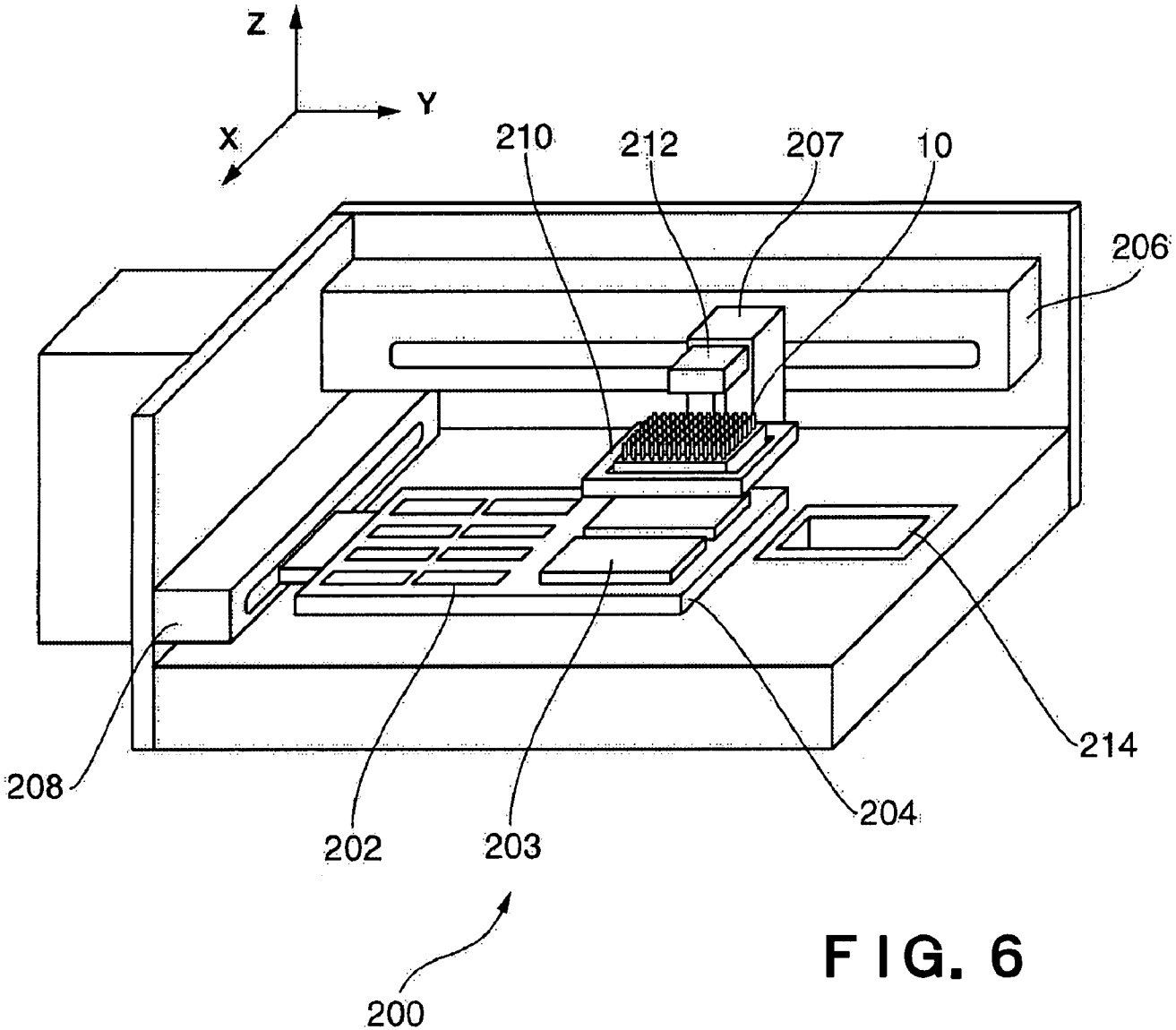
FIG. 6 is an example showing the droplet discharging device pertaining to the invention.

Next, FIG. 6 is a diagram for explaining a configuration example of a microarray manufacturing device 200 as an example of the foregoing droplet discharging device.

The microarray manufacturing device 200 is for manufacturing a microarray prepared by disposing a plurality of droplets of a sample solution containing biological molecules on a substrate 202 such as glass, and includes a table 204 capable of mounting a plurality of substrates 202, a Y direction drive shaft 206 that freely moves the inkjet head 10 or 60 in the Y direction, and an X direction drive shaft 208 that freely moves the table 204 in the X direction. [The microarray manufacturing device 200] further includes a fixation unit 210 for fixing the inkjet head 10 or 60, a suction unit 212 that adheres to the nozzle forming face of the inkjet head 10 and which is capable of performing suction from the nozzle, and a Z direction drive shaft 207 that freely moves the fixation unit 210 and suction unit 212 in the Z direction.

Further, the 96 microtiter plates 203 for storing the sample solution are also prepared on the table 204, and a cleansing bath storing cleaning solution is also provided thereto.

Incidentally, in this embodiment, the suction unit 212 is configured to supply gas into the nozzle in addition to sucking gas out from the nozzle.

Figure 7A:
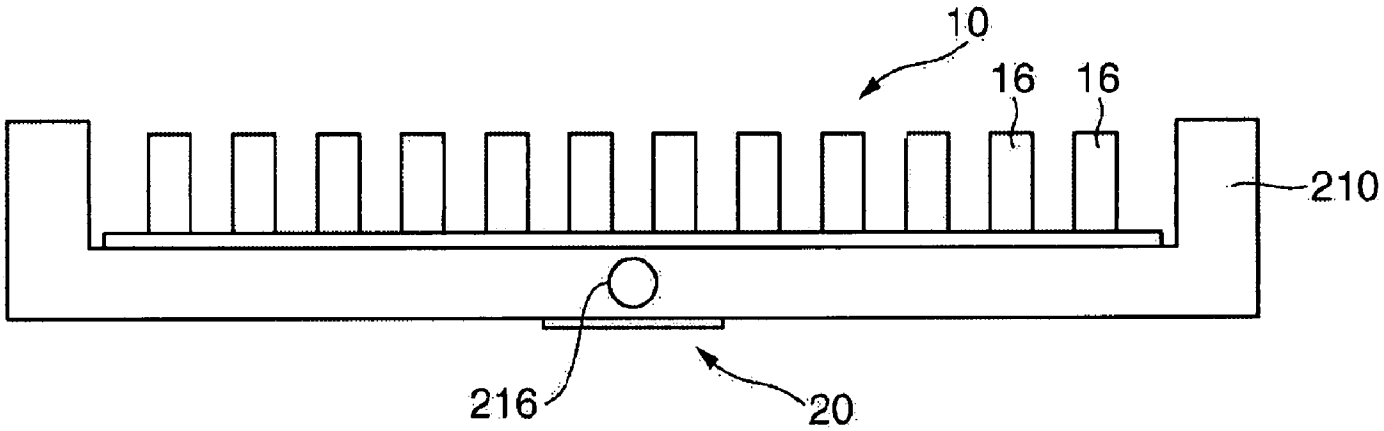
FIGS. 7(A) and (B) are explanatory diagrams showing the operation of the fixation unit of the droplet discharging device pertaining to the invention.
Figure 7B:
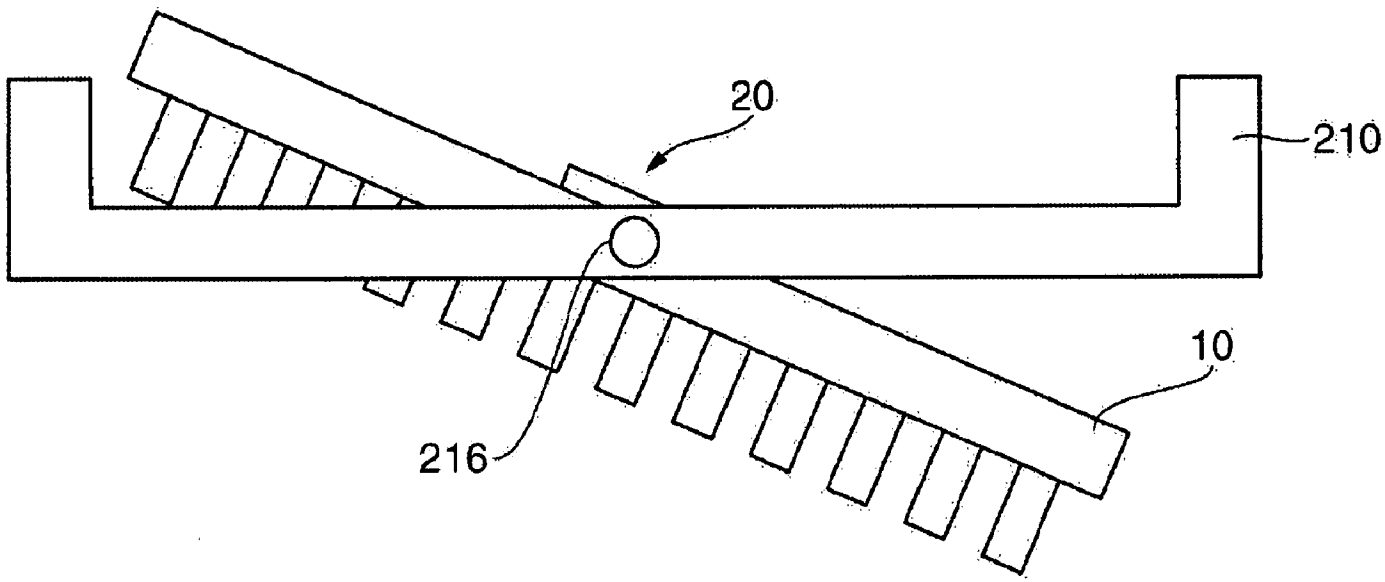

Here, FIG. 7 is a view showing a frame format taking a case of fixing the inkjet head 10 and viewing the fixation unit 210 from the left and right directions in FIG. 6. The inkjet head 10 is fixed to the fixation unit 210 with a rotary shaft 216, and it is possible to rotate, around this rotary shaft, only the inkjet head 10 in plane including the vertical direction. FIG. 7(A) shows a state where the inkjet head 10 is fixed with the nozzle facing downward, and FIG. 7(B) shows a halfway state where the nozzle is rotated upward. In a state where the nozzle is facing upward or downward and the substrate of the inkjet head 10 is horizontal (for instance, the state shown in FIG. 7(A)), the inkjet head 10 can be fixed to the fixation unit 210 with a fastener or the like.

Microarray Manufacturing Process

Next, the manufacturing method of a microarray to be conducted with the microarray manufacturing device 200 of this embodiment is explained.

Further, a sample solution containing biological molecules (for instance, DNA, protein, etc.) to be discharged is prepared in 96 microtiter plates 203 having wells (sample retention units) in the same number as, and disposed in the same spacing as, the supply ports, and this is disposed on the table 204.

Next, the inkjet head 10 is fixed with the fixation unit 210 so that the head chip 20 having the nozzle 22 faces upward, and the supply port 16 faces downward. And, the X direction drive shaft and Y direction drive shaft 206 are operated so as to dispose the inkjet head 10 immediately above the microtiter plate 203, and the Z direction drive shaft is operated so as to move the inkjet head 10 downward until the tip of the supply port 16 immerses in the sample solution in the respective wells of the microtiter plate.

Figure 8:
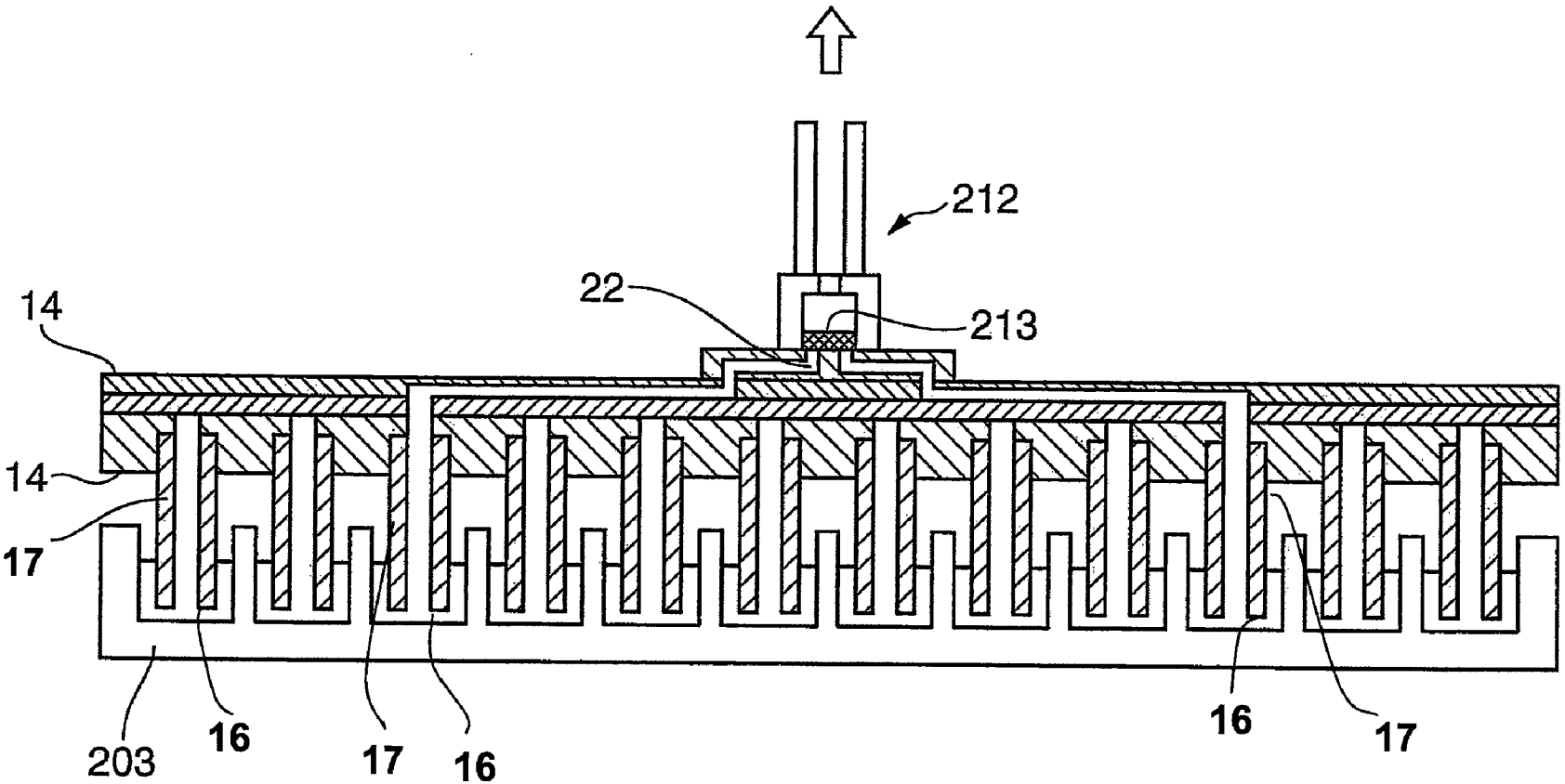
FIG. 8 is an example of a cross section showing the usage mode of the droplet discharging head pertaining to the invention.

Next, the Z direction drive shaft is operated so that the suction unit 212 adheres to the inkjet head 10 so as to cover the nozzle 22. FIG. 8 shows a schematic cross section for explaining this state. By operating the suction unit 212 and performing suction from the nozzle, the sample solution in the microtiter plate 203 is sucked into the supply port 16. The sucked solution passes through the channel and pressure chamber and reaches the tip of the nozzle. The suction unit 213 is provided with a gas-liquid separation filter 213, and the filter 213 comes in contact with the nozzle tip when the suction unit 213 is adhered to the inkjet head 10. Since the filter 213 only permeates gas, after sucking the liquid until it comes in contact with the filter 213, such suction is continued for a short period of time in order to eliminate the air bubbles contained in the solution, and the discharge preparation is thereby completed.

Next, the Z direction drive shaft 207 is operated to separate the suction unit 212 from the inkjet head 10, and the inkjet head 10 is rotated and fixed such that the nozzle 20 faces downward. And, the X direction drive shaft 208 and Y direction drive shaft 206 are operated to dispose the inkjet head 10 immediately above the microarray substrate 202. Then, the Z direction drive shaft is operated to adjust the distance between the inkjet head 10 and microarray substrate 202, and the sample solution is thereby discharged.

When there is no more solution to be discharged, the inkjet head 10 is moved once again, the foregoing steps are repeated, and the sample solution may be sucked from the microtiter plate once again.

Cleansing Step

When changing the sample solution to be discharged, the inkjet head 10 is cleansed according to the following steps.

Foremost, after discharging the initial sample solution, the Z direction drive shaft 207 is operated to raise the inkjet head 10 to an appropriate height, and the Y direction drive shaft 206 is thereafter operated to dispose the inkjet head 10 immediately above the cleansing bath 214. Next, the inkjet head 10 is rotated and fixed such that the nozzle 22 faces downward, and the Z direction drive shaft 207 is operated to immerse the supply port 16 in the cleansing solution in the cleansing bath 214. The suction unit 212 is also raised and lowered with the Z direction drive shaft 207, and performs suction by being adhered to the inkjet head 10. After sufficiently introducing the cleansing solution into the inkjet head 10 until it comes in contact with the gas-liquid separation filter, gas is inserted from the suction unit 212 to discharge the cleaning solution. Gas may be further supplied for drying.

Next, the Z direction drive shaft 207, X direction drive shaft 208 and Y direction drive shaft 206 are operated to position the inkjet head 10 immediately above the microtiter plate storing a sample solution to be used in the subsequent discharge, and the Z direction drive shaft 207 is operated to immerse the supply port 22 of the inkjet head 10 in the sample solution in the well.

Thereafter, the process up to the discharging step is the same as the foregoing explanation, and is therefore omitted here.

According to an aspect of the invention, as described above, since the liquid (sample solution, cleaning solution) can be efficiently introduced into the inkjet head from the supply ports, microarrays can be hyper-produced by repeatedly filling the sample solution and discharging this to the microarray substrate, and performing the cleansing step as necessary.

Incidentally, the invention is not limited to the subject matter of the embodiments described above, and may be variously modified within the scope of the gist of the invention. For instance, the number of nozzles, liquid retention units and supply ports is not limited to 96, and may be freely changed to match the number of wells of a sample container such as a microtiter plate to be used. Further, the liquid to be discharged is not limited to liquid containing biological molecules, and there is no limitation so as long as the liquid can be discharged from the inkjet head.

What is claimed is:

1. A droplet discharging device, comprising:

(a) a droplet discharging head, including:

(1) a nozzle formed on a first principal surface, (2) a pressurized room having a pressurization unit that applies pressure on liquid discharged from the nozzle, (3) a liquid retention unit in communication with the pressurized room, and (4) a supply port that supplies liquid to the liquid retention unit, wherein the supply port is provided protrusively from a second principal surface positioned on the opposite side of the first principal surface, wherein the supply port and the liquid retention unit are formed integrally in a tubular shape;

(b) a fixation unit that fixes the droplet discharging head so that the supply port faces upward or downward; and (c) a suction unit that adheres to the first principal surface so as to cover a nozzle of the droplet discharging head, and which is capable of sucking gas or liquid inside the droplet discharging head from the nozzle.

2. The droplet discharging device according to claim 1, wherein the supply port is internally configured from a surface having lyophilic property.

3. The droplet discharging device according to claim 1, wherein the fixation unit is capable of rotating the droplet discharging head in plane including the vertical direction.

4. The droplet discharging device according to claim 1, further comprising a gas-liquid separation filter that contacts the nozzle when the suction unit adheres to the first principal surface.

5. A manufacturing method of a microarray using a mounted droplet discharging head including a nozzle formed on a first principal surface, a pressurized room having a pressurization unit that applies pressure on liquid discharged from the nozzle, a liquid retention unit in communication with the pressurized room, and a supply port that supplies liquid to the liquid retention unit, the method comprising the steps of:

preparing a sample solution in a container having a well in the same number as, and disposed in the same spacing as, the supply port;

fixing the droplet discharging head so that the nozzle faces upward;

immersing the supply port in the sample solution in the well;

operating the suction unit upon affixing it to the first principal surface of the droplet discharging head, and introducing the sample solution into the liquid retention unit and pressurized room;

separating the suction unit from the first principal surface, and fixing the droplet discharging head so that the nozzle faces downward; and discharging the sample solution to a substrate.

6. The manufacturing method of a microarray according to claim 5, further comprising the steps of:

after discharging the sample solution to the substrate, fixing the droplet discharging head so that the nozzle faces upward;

immersing the supply port in a cleaning solution; and operating the suction unit upon affixing it to the first principal surface of the droplet discharging head, introducing the cleaning solution into the liquid retention unit, and discharging the cleaning solution from the liquid retention unit.

* * * * *